US011421483B2

(12) United States Patent
Eve

(10) Patent No.: US 11,421,483 B2
(45) **Date of Patent: *Aug. 23, 2022**

(54) HYBRID BIT INCLUDING EARTH-BORING AND PERCUSSION ELEMENTS FOR DRILLING EARTH FORMATIONS

(71) Applicant: Jonathan M. Eve, Edmond, OK (US)

(72) Inventor: Jonathan M. Eve, Edmond, OK (US)

(73) Assignee: Jonathan M. Eve, Edmond, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/878,367

(22) Filed: May 19, 2020

(65) Prior Publication Data

US 2020/0277824 A1 Sep. 3, 2020

Related U.S. Application Data

(63) Continuation of application No. 15/915,048, filed on Mar. 7, 2018, now Pat. No. 10,655,396.

(Continued)

(51) Int. Cl.

*E21B 10/40* (2006.01)
*E21B 10/54* (2006.01)

(Continued)

(52) U.S. Cl.

CPC ..... *E21B 10/40* (2013.01); *E21B 10/32* (2013.01); *E21B 10/42* (2013.01); *E21B 10/43* (2013.01); *E21B 10/54* (2013.01); *E21B 10/62* (2013.01)

(58) Field of Classification Search

CPC ..... E21B 10/40; E21B 10/42; E21B 10/43; E21B 10/32; E21B 10/54; E21B 10/62;

(Continued)

(56) References Cited

U.S. PATENT DOCUMENTS 2,873,093 A 2/1959 Hildebrandt et al.
3,130,799 A 4/1964 Williams (Continued)

FOREIGN PATENT DOCUMENTS

CN 102678055 A 9/2012
CN 105156039 A 12/2015
JP 2007247199 A 9/2007

OTHER PUBLICATIONS

Chinese National Intellectual Property Administration, "First Office Action," Chinese Application No. 201880030280.7, dated Sep. 4, 2020.

(Continued)

*Primary Examiner* — Yong-Suk (Philip) Ro

(74) *Attorney, Agent, or Firm* — Dentons Durham Jones Pinegar

(57) ABSTRACT

A hybrid bit includes an earth-boring element and a percussion element. The earth-boring element and the percussion element are coaxially arranged, with the earth-boring element surrounding the percussion element. A reciprocating member of the percussion element may oscillate in a manner that enables a bottom end of the reciprocating member to repeatedly protrude from a bottom end of the earth-boring element and to be repeatedly withdrawn. A configuration of the earth-boring element may enable it to drill into and remove some materials from an earth formation, while the percussion element may enable the hybrid bit to drill into and remove difficult-to-drill materials, including abrasive materials and/or materials with high compressive forces, such as chert.

20 Claims, 3 Drawing Sheets

Related U.S. Application Data

(60) Provisional application No. 62/468,363, filed on Mar. 7, 2017.

(51) Int. Cl.

| | |
|---|---|
| ***E21B 10/42*** | (2006.01) |
| ***E21B 10/43*** | (2006.01) |
| ***E21B 10/62*** | (2006.01) |
| ***E21B 10/32*** | (2006.01) |

(58) Field of Classification Search
CPC ..... E21B 6/04; E21B 4/06; E21B 6/00; E21B 6/02; E21B 6/08; E21B 10/36
See application file for complete search history.

(56) References Cited

U.S. PATENT DOCUMENTS

| | | | | |
|---|---|---|---|---|
| 3,219,131 | A | 11/1965 | Boyd | |
| 4,852,672 | A | 8/1989 | Behrens | |
| 7,240,744 | B1 | 7/2007 | Kemick | |
| 8,011,457 | B2 | 9/2011 | Hall et al. | |
| 8,225,883 | B2 | 7/2012 | Hall et al. | |
| 8,297,378 | B2 | 10/2012 | Hall et al. | |
| 8,360,174 | B2 | 1/2013 | Hall et al. | |
| 8,499,857 | B2 | 8/2013 | Hall et al. | |
| 10,655,396 | B2 * | 5/2020 | Eve | E21B 10/54 |
| 2004/0256155 | A1 * | 12/2004 | Kriesels | E21B 7/002 175/57 |
| 2007/0114061 | A1 | 5/2007 | Hall et al. | |
| 2008/0156536 | A1 | 7/2008 | Hall et al. | |
| 2009/0065251 | A1 | 3/2009 | Hall et al. | |
| 2009/0183920 | A1 | 7/2009 | Hall et al. | |

OTHER PUBLICATIONS

Japan Patent Office, "Office Action," Japanese Application No. 2019-570343, dated Sep. 1, 2020.

European Patent Office, "Communication pursuant to Article 94(3) EPC," European Application No. 18764248.3, dated Nov. 2, 2020.

Chinese National Intellectual Property Administration, "Second Office Action," Chinese Application No. 2018800302807, dated Apr. 7, 2021.

Chinese National Intellectual Property Administration, "Third Office Action," Chinese Application No. 201880030280.7, dated Sep. 6, 2021.

Japan Patent Office, "Notice of Allowance" Japanese Application No. 2019-570343, dated Jun. 29, 2021.

* cited by examiner

HYBRID BIT INCLUDING EARTH-BORING AND PERCUSSION ELEMENTS FOR DRILLING EARTH FORMATIONS

CROSS-REFERENCE TO RELATED APPLICATION

This application is a continuation of U.S. patent application Ser. No. 15/915,048, filed Mar. 7, 2018 and titled HYBRID BIT INCLUDING EARTH-BORING AND PERCUSSION ELEMENTS FOR DRILLING EARTH FORMATIONS ("the '048 Application"), now U.S. Pat. No. 10,655,396, issued May 19, 2020, in which a claim for priority to the Mar. 7, 2017 filing date of U.S. Provisional Application No. 62/468,363, titled HYBRID BIT INCLUDING EARTH-BORING AND PERCUSSION ELEMENTS FOR DRILLING EARTH FORMATIONS ("the '363 Provisional Application") was made pursuant to 35 U.S.C. § 119(e). The entire disclosures of the '048 Application and the '363 Provisional Application are hereby incorporated herein.

TECHNICAL FIELD

This disclosure relates generally to bits for drilling into earth formations and, more specifically, to hybrid bits for drilling earth formations. More specifically, this disclosure relates to hybrid bits that include integrated earth-boring and percussion elements and, even more specifically to bits that include an earth-boring bit and a percussion element that are integrated with one another. Methods for forming boreholes (e.g., oil wells, gas wells, etc.) in earth formations are also disclosed.

RELATED ART

Earth-boring drill bits are commonly used to drill into a variety of earth formations. While drilling through some formations (e.g., limestone formations, etc.), harder, more difficult-to-drill materials (e.g., abrasive materials, materials with high compressive strengths, etc.), such as chert, may be encountered. In order to continue drilling through such difficult-to-drill materials, hammering elements, which are also known as percussion elements, may be required.

If a difficult-to-drill material is encountered with bottom hole assembly (BHA) that lacks a hammering element, the drill string must be removed from the borehole, or well, so that the hammering element can be incorporated into the BHA. Once the hammering element is introduced into the borehole, drilling can resume.

Conventionally, pneumatic (i.e., air driven) hammering elements, which are also referred to in the art as down-the-hole (DTH) drills, have been used to assist in breaking up difficult-to-drill materials. Pneumatic hammering elements function like jack hammers at the bottom or end of a borehole. When use of the DTH is complete, it must be removed from the borehole, and then a BHA that includes a bit may be re-introduced into the borehole. The repeated removal of a drill string from the borehole and replacement of the drill string in the borehole can undesirably consume valuable drilling time.

More recently, hydraulic hammering elements have been developed. Typically, a drill bit is attached to the bottom end of the hydraulic hammering element. The hammering element induces axial oscillation in the earth-boring drill bit, causing the pressure and force with which it engages the formation at the end or bottom of the borehole to oscillate, which may subject an earth-boring drill bit to forces for which the drill bit is not designed. The use of conventional earth-boring drill bits with hammering elements may cause the earth-boring drill bits to fail prematurely.

DISCLOSURE

In one aspect, a hybrid bit according to this disclosure includes a percussion element and an earth boring element that are integrated with one another. The percussion element of such a hybrid bit may also be referred to herein as a "hammering element" or as a "percussion bit." The earth-boring element of a hybrid bit according to this disclosure may also be referred to as an "earth-boring drill bit." In addition to the percussion element and the earth-boring element, a hybrid bit according to this disclosure includes a connector.

The percussion element and the earth-boring element may be coaxially arranged, with the earth-boring element surrounding the percussion element. Relative axial positions of the earth-boring element and the percussion element may be fixed. In some embodiments, an upper portion of the earth-boring element and an upper portion of the percussion element and, more specifically, an upper portion of a fixed member of the percussion element may be secured to one another. A lower portion of the percussion element, including a reciprocating member that surrounds a lower portion of the fixed member of the percussion element, may be located within a throat in the lower portion of the earth-boring element and, thus, surrounded by, but not secured to the lower portion of the earth-boring element. Such an arrangement may enable the reciprocating member to oscillate, or move up and down or back and forth, depending upon the orientation of the hybrid bit, axially within the throat of the of the earth-boring element.

A bottom end, or a bottom surface, of the percussion element is exposed at a bottom end of the earth-boring element. As the percussion element oscillates along the axis, or length, of the earth-boring element and of the hybrid bit, the bottom end of the percussion element cycles through movement to different locations relative to the bottom end of the earth-boring element. Thus, the location of the bottom end of the percussion element relative to the bottom end of the earth-boring element may vary depending upon the position of the reciprocating member of the percussion element along the lower portion of the fixed member of the percussion element and, thus, the position of the reciprocating member relative to the lower portion of the earth-boring element. While the reciprocating member is in its lowest position along the length of the lower portion of the fixed member, the bottom end of the percussion element protrudes from the bottom end of the earth-boring element. When the reciprocating member is in its highest position along the length of the lower portion of the fixed member, the bottom end of the percussion element may be recessed relative to the bottom end of the earth-boring element, substantially flush or flush with the bottom end of the earth-boring element, or protrude slightly from the bottom end of the earth-boring element.

The bottom end of the percussion element may have a configuration that enables it to contact and engage, or interface with, an earth formation at the bottom or end of a borehole. In addition, a configuration of the percussion element may enable it to withstand the forces that result from oscillation of its reciprocating member, including the manner in which the bottom end of the percussion element interacts with the bottom or end of the borehole during such oscillation (e.g., vibration, repeated changes the force applied by the bottom end of the percussion element to the bottom or end of the borehole, repeated impacts against the earth formation, etc.). In some embodiments, a configuration of the percussion element may enable the bottom end of the reciprocating member to apply oscillating forces generated by oscillation of the reciprocating member to the bottom or end of the borehole while the earth-boring element applies little or none of the oscillating forces to the bottom or end of the borehole.

As the bottom end of the percussion element of a hybrid bit absorbs the forces induced by oscillation of the reciprocating member of the percussion element, it may also enhance contact between the bottom of the borehole and the earth-boring element of the hybrid bit. The manner in which the percussion element and the earth-boring element are arranged may enable the reciprocating member of the percussion element to oscillate while limiting oscillation of the earth-boring element; i.e., the extent to which earth-boring element oscillates, or its stroke length, is less than the extent to which the reciprocating member oscillates, enabling the earth-boring element to function as a conventional earth-boring drill bit rather than as a hammer.

In other embodiments of hybrid bits according to this disclosure, the earth-boring element may be secured to the reciprocating member of the percussion element. In such embodiments, oscillation of the reciprocating member causes equal oscillation of the earth-boring element.

In another aspect, methods for drilling earth formations according to this disclosure include use of a hybrid bit, in which at least some of the drilling is performed by the earth-boring element of the hybrid bit and at least some of the drilling occurs with the percussion element of the hybrid bit. Such a method may include introducing a drill string into an earth formation, with a hybrid bit that includes a percussion element coaxially surrounded by an earth-boring element at a bottom of the drill string. The earth-boring element may be used to drill into the earth formation under a suitable weight on bit (WOB). The reciprocating member of the percussion element of the hybrid bit may oscillate axially to repeatedly lift the WOB, which may introduce vibrations into the bottom or end of the borehole, or even cause the reciprocating member to repeatedly impact the bottom or end of the borehole. Operation of the earth-boring element and the percussion element in concert with one another may enable these elements to efficiently drill through a variety of different types of materials in the earth formation, without requiring that the drill string be removed from the borehole for optimization of the BHA when new types of materials are encountered.

In some embodiments, the earth-boring element and the percussion element may operate at the same time. In other embodiments, the earth-boring element may operate continuously, while the percussion element may operate selectively (e.g., upon application of at least a threshold hydraulic pressure (e.g., of drilling fluid, or mud, etc.) within the percussion element, by application of at least a threshold force (e.g., WOB, etc.) to the percussion element, etc.). In still other embodiments, the percussion element may operate while operation of the earth-boring element may be selectively controlled (e.g., by rotating the hybrid bit, applying a WOB, etc.). In embodiments where operation of percussion element and, optionally, the earth-boring element are selectively controlled, once use of the percussion element (with or without the earth-boring element) enables the hybrid bit to pass through a particularly difficult location in the earth formation (e.g., through chert, etc.), use of the percussion element may be terminated, and the earth-boring element may again be used to drill into the earth formation. Similarly, if the percussion element is worn or damaged, its use may be terminated and use of the earth-boring element may continue or resume.

Other aspects of the disclosed subject matter, as well as features and advantages of various aspects of the disclosed subject matter, will be apparent to those of ordinary skill in the art from the ensuing description, the accompanying drawings, and the appended claims.

DETAILED DESCRIPTION

Figure 1:
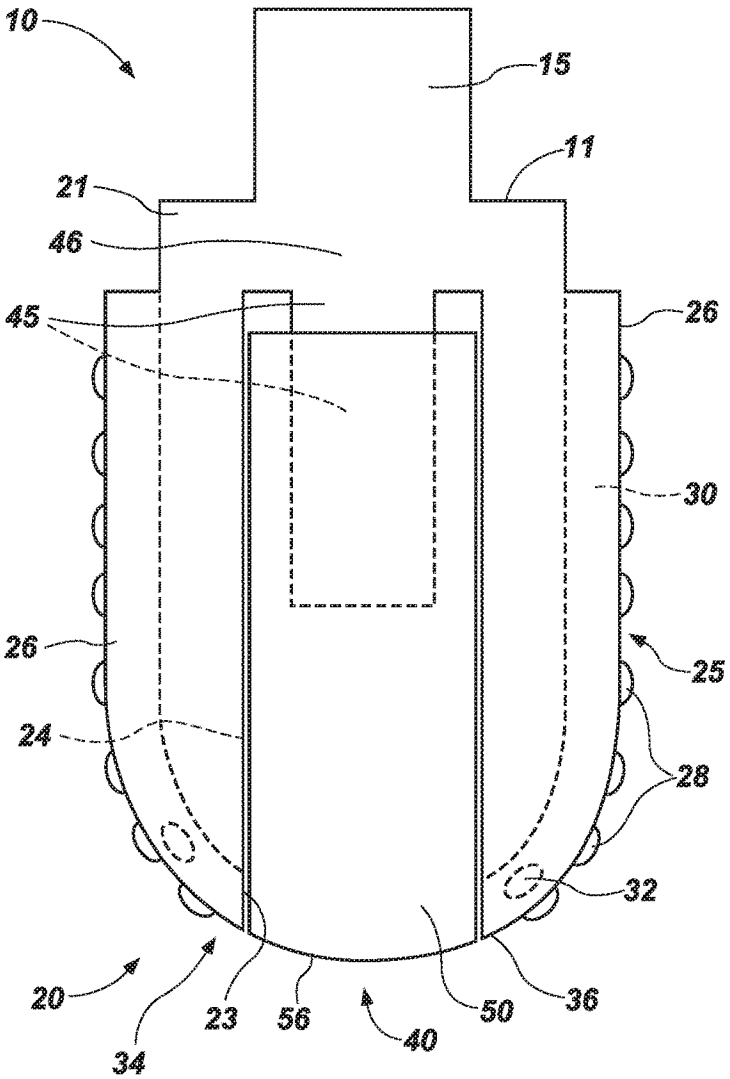

With reference to FIG. 1, a cross-sectional representation of hybrid bit 10 according to this disclosure is depicted. The hybrid bit 10 includes an earth-boring element 20 and a percussion element 40. The earth-boring element 20 and the percussion element 40 are coaxially arranged, with a throat 23 of the earth-boring element 20 receiving the percussion element 40. At its top end 11, the hybrid bit 10 also includes a connector 15.

The earth-boring element 20 may be configured similarly to a coring bit, with a relatively wide throat 23 located axially and defining an interior of the earth-boring element 20. The throat 23 has a diameter that enables it to receive the percussion element 40.

At its exterior 25, the earth-boring element 20 may have a configuration that resembles that of an earth-boring drill bit. As depicted, the earth-boring element 20 is configured as a so-called "drag bit" or "PDC bit," with its exterior 25 including a plurality of somewhat radially protruding blades 26 with pockets (not shown) that carry polycrystalline diamond compact (PDC) cutters 28, and junk slots 30 between adjacent blades 26. The blades 26 define a gage of the earth-boring element 20 and a nose 34 at the bottom of the earth-boring element 20. In addition, such an earth-boring element 20 may include internal fluid courses (not shown) and nozzles 32 that communicate drilling fluid, or "mud," to the exterior 25 of the earth-boring element 20. The features of the earth-boring element 20, including the features on its exterior 25, may be selected and arranged in any suitable manner, and their selection and arrangement, along with other features of the earth-boring element 20, may be optimized for use with the particular earth formation or type of earth formation that is to be drilled. As an alternative to including the features of a drag bit, the earth boring element 20 may have the configuration of a diamond impregnated bit, the configuration of a hybrid of a drag bit and a diamond impregnated bit (e.g., FuseTech™, KYMERA® from Baker Hughes Incorporated, etc.), or the configuration of a hybrid drag bit-roller cone bit.

The throat 23 of the earth-boring element 20 may include one or more recesses 24 that are longitudinally oriented, and which may define channels between the throat 23 and the percussion element 40 that facilitate the flow of drilling fluid between the earth-boring element 20 and the percussion element 40. The flow of drilling fluid through the recesses 24 may enable lubrication, cooling, and/or cleaning of the percussion element 40 and/or of the earth-boring element 20.

The percussion element 40 may comprise a hydraulic percussion element (e.g., a percussion element that operates as drilling fluid flows therethrough, etc.) or a pneumatic percussion element (i.e., an air hammer) that may be used as part of a bottom hole assembly of a drill string. As a specific, but non limiting example, the percussion element 40 comprises a hydraulic percussion element, which may be configured similarly to the FluidHammer® drilling tool available from National Oilwell Varco (NOV) of Houston, Tex.

More specifically, the percussion element 40 may include a fixed member 45 and a reciprocating member 50. The fixed member 45 may include an upper portion 46 that is secured to, or may even be integral with, an upper portion 21 of the earth-boring element 20. The reciprocating member 50 is capable of moving longitudinally over a bottom portion 47 of the fixed element 45 and longitudinally through the throat 23 of the earth-boring element 20.

FIG. 1 depicts the reciprocating member 50 of the percussion element 40 in a fully withdrawn position, in which a bottom end 56 of the reciprocating member 50 and, thus, of the percussion element 40 is flush with a bottom surface 36 of the nose 34 of the earth-boring element 20 of the hybrid bit 10. Alternatively, the bottom end 56 of the percussion element 40 may be slightly recessed relative to the bottom surface 36 of the nose 34 of the earth-boring element 20 or it may protrude slightly from the bottom surface 36 of the nose 34 of the earth-boring element 20 when the reciprocating member 50 is in its fully withdrawn position.

Figure 2:
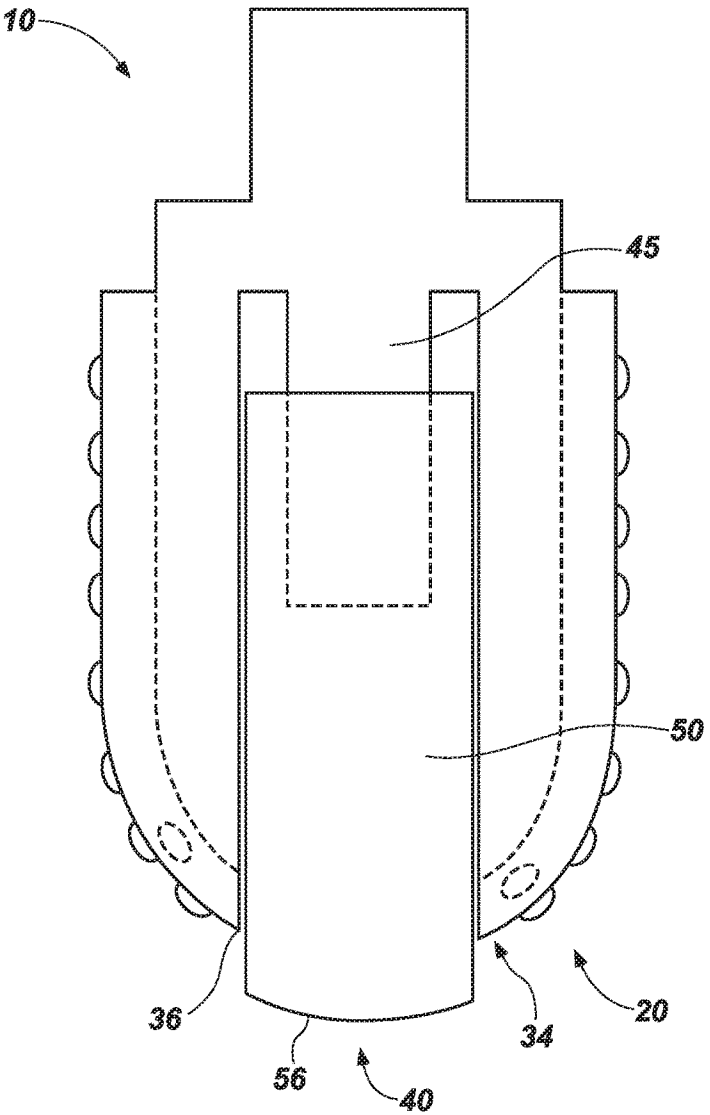
FIGS. 1 and 2 provide a cross-sectional representations of a hybrid bit according to this disclosure, depicting an embodiment of an arrangement between a percussion element of the hybrid bit and an earth-boring element of the hybrid bit.

In FIG. 2, the reciprocating member 50 of the percussion element 40 is shown in a fully extended position, in which the bottom end 56 of the percussion element 40 protrudes beyond the bottom surface 36 of the nose 34 of the earth-boring element 20. The distance the fully extended reciprocating member 50 and its bottom end 56 protrude beyond the bottom surface 36 of the nose 34 of the earth-boring element 20 corresponds to the stroke length of the reciprocating member 50. Any of the stroke length of the reciprocating member 50, the percussion force the bottom end 56 of the reciprocating member 50 exerts on an earth formation at the bottom or end of a borehole, and/or the frequency with which the reciprocating member 50 oscillates, or cycles back and forth, may be tailored for any of a variety of purposes. These may include, but are not limited to, use of the percussion element 40 with a certain type and/or configuration of earth-boring element 20, the manner in which the hybrid bit 10 is used (e.g., vertical drilling, directional drilling, etc.), and the type of earth formation that is being drilled (e.g., the materials that will be encountered during drilling, the conditions that are encountered during drilling, etc.).

In embodiments of hybrid bits 10 where the percussion element 40 comprises a hydraulic percussion element, the flow of drilling fluid through the drill string may be split between the percussion element 40 and the earth-boring element 20. Of course, the flow of drilling fluid to the percussion element 40 (e.g., about 180 gpm (gallons per minute), about 200 gpm, etc.) may be sufficient to drive the percussion element 40 (i.e., capable of reaching and/or exceeding a threshold hammering pressure), or to cause the percussion element 40 to operate as intended, while the flow of drilling fluid into and though the earth-boring element 20 may be sufficient to lubricate cool, and/or clean the earth-boring element 20 and, optionally, the percussion element 40.

The flow of sufficient drilling fluid into the percussion element 40 may alone be sufficient for the percussion element 40 to operate (i.e., for the reciprocating member 50 to oscillate). Alternatively, operation of the percussion element 40 may be further dependent upon placement of the bottom end 56 of the percussion element 40 in contact with the bottom or end of a borehole and, optionally, upon placement of at least a threshold weight (e.g., WOB) on the percussion element 40 and its reciprocating member 50.

The connector 15 may enable the hybrid bit 10 to be connected to a drill string as part of a BHA of the drill string or as the BHA of the drill string. The connector 15 may comprise a standard API (American Petroleum Institute) threaded connector, with a size that corresponds to a size (i.e., diameter) of the hybrid bit 10 and, thus, of its earth-boring element 20.

Turning now to FIGS. 3-7, non-limiting embodiments of hybrid bits 10' and 10" according to this disclosure are illustrated.

Figure 3:
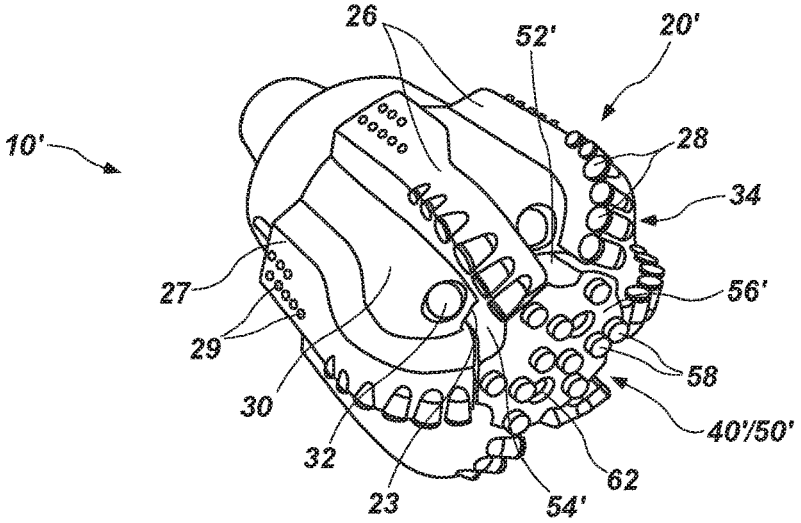
FIGS. 3 and 4 are bottom perspective views of an embodiment of hybrid bit according to this disclosure.
Figure 4:
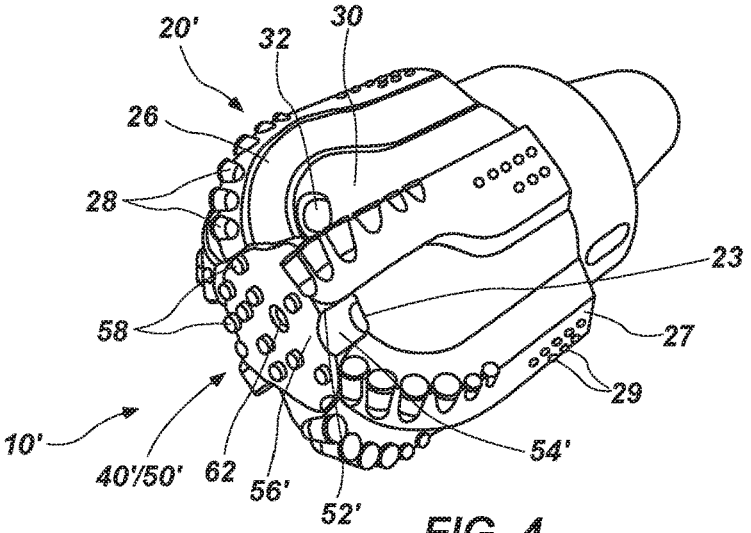
Figure 5:
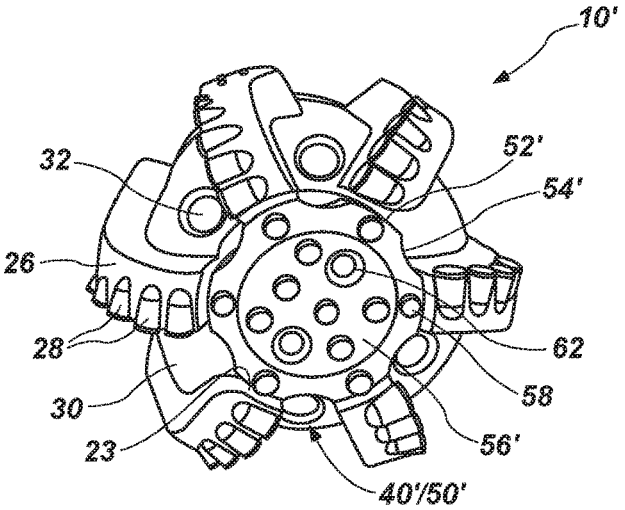
FIG. 5 is a bottom view of the embodiment of hybrid bit shown in FIGS. 3 and 4.

The hybrid bit 10' shown in FIGS. 3-5 includes a drag-type earth-boring element 20' with six (6) blades 26, each of which carries a plurality of cutters 28, which may comprise PDC cutters. In addition, a gage surface 27 of each blade 26 may carry gage protectors 29, gage cutters (not shown), and/or a gage pad (not shown). The recessed area between each adjacent pair of blades 26 comprises a junk slot 30. Some of the junk slots 30 include nozzles 32, which may direct drilling fluid from fluid courses within a body of the earth-boring element 20' in a direction and at a pressure that will sweep cuttings and other debris from the nose 34 of the earth-boring element 20', enabling it to cut into an earth formation efficiently while preventing abrasive scouring of the earth-boring element 20' and its features and components.

The percussion element 40' of the hybrid bit 10' includes a reciprocating member 50' that can oscillate within a throat 23 of the earth-boring element 20'. The reciprocating member 50' includes a bottom end 56' that includes button inserts 58, or tungsten carbide inserts. The button inserts 58 may comprise conical button inserts and/or chisel button inserts. Conical button inserts 58 may grind materials that are abrasive and materials with high compressive strengths. Chisel button inserts 58 may grind and cut into materials that are abrasive and materials with high compressive strength. In addition, nozzles 62 may direct the flow of drilling fluid from within the reciprocating member 50' onto its bottom end 56'.

A peripheral surface 52' of the reciprocating member 50' of the percussion element 40' may include recesses 54' that are oriented longitudinally along the peripheral surface 52'. The recesses 54' may, along with the throat 23, which defines an interior surface of the earth-boring element 20', define channels between the throat 23 and the peripheral surface 52' of the percussion element 40'. The recesses 54' and the channels that are partially defined thereby may facilitate the flow of drilling fluid between the earth-boring element 20 and the percussion element 40. The flow of drilling fluid through the recesses 54' may enable lubrication, cooling, and/or cleaning of the percussion element 40' and/or of the earth-boring element 20'.

Figure 6:
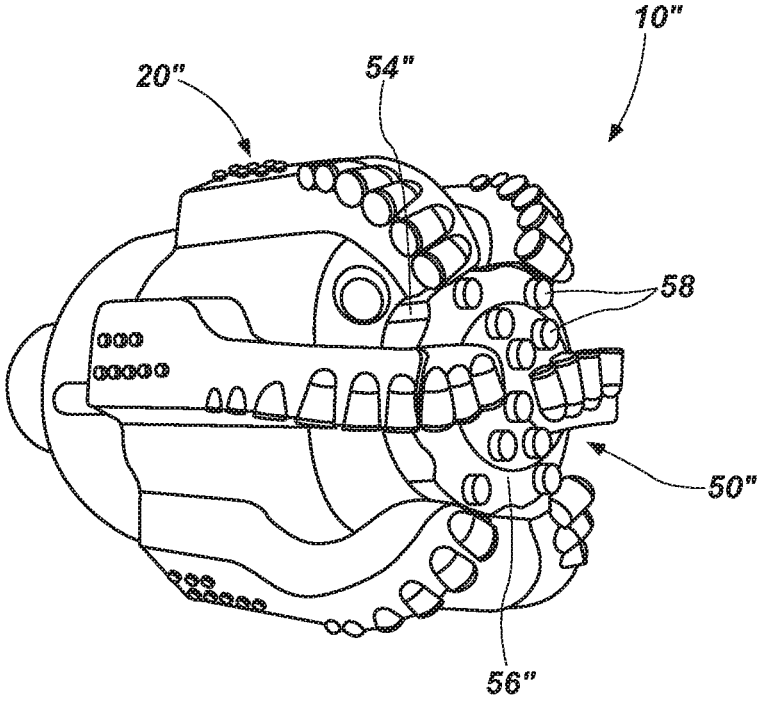
FIG. 6 is a bottom perspective view of another embodiment of hybrid bit according to this disclosure.
Figure 7:
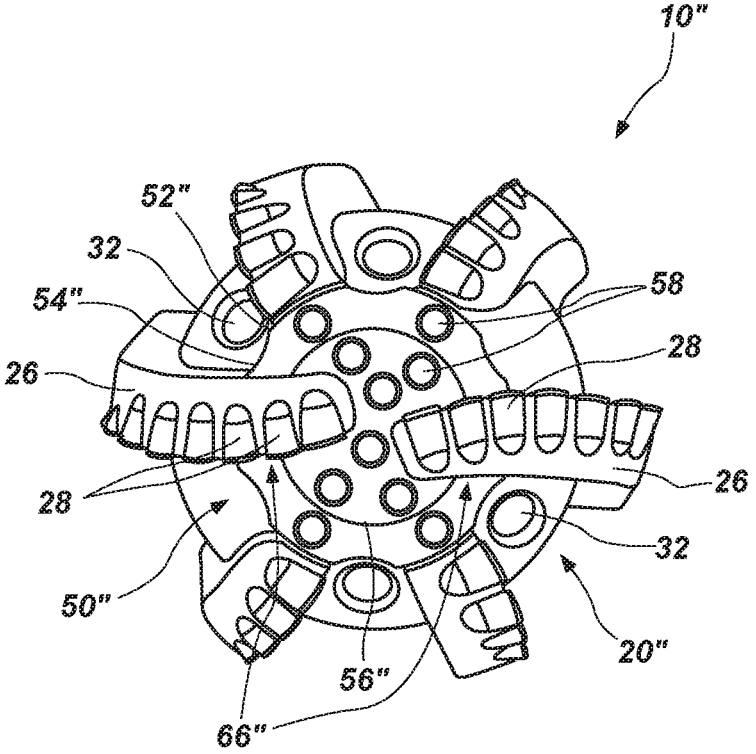
FIG. 7 is a bottom view of the embodiment of hybrid bit shown in FIG. 6.

The embodiment of hybrid bit 10" illustrated by FIGS. 6 and 7 includes an earth-boring element 20" with features and components that are the same as those of the earth-boring element 20' of the hybrid bit 10 shown in FIGS. 3-5. In addition, like the percussion element 40' of the hybrid bit 10' shown in FIGS. 3-5, the percussion element 40" of the hybrid bit 10" shown in FIGS. 6 and 7 includes a reciprocating member 50" with a bottom end 56" that carries button inserts 58 and a peripheral surface 52" along which longitudinally oriented, channel-defining recesses 54" extend. In place of nozzles 62 (FIGS. 3-5), however, a pair of blade extensions 66" protrudes from the bottom end 56". The blade extensions 66" on the bottom end 56" of the reciprocating member 50" of the percussion element 40" may be aligned with a corresponding pair of blades 26 of the earth-boring element 20" and, therefore, may guide drilling fluid ejected by nozzles 32 that are adjacent to those blades 26 onto the bottom end 56" to lubricate, cool, and/or clean the bottom end 56". Each blade extension 66" may also carry one or more cutters 28.

In use, a hybrid bit 10, 10', 10", etc., according to this disclosure may be assembled at the bottom of a drill string. The hybrid bit 10, 10', 10", etc., may be used with other downhole tools, including a motor and other components of a BHA.

With returned reference to FIGS. 1 and 2, a hybrid bit 10 according to this disclosure may be used in vertical drilling, as well as with directional drilling tools. Such a hybrid bit 10 may define or be introduced into a borehole in a manner known in the art.

Rotation of the hybrid bit 10 may enable the earth-boring element 20 thereof to function as a conventional earth-boring drill bit (e.g., as a drag bit, etc.). When the percussion element 40 operates at the same time as the earth-boring element 20 rotates, a configuration of the hybrid bit 10 may enable the percussion element 40 to apply forces, including percussive forces against the bottom or end of the borehole, without causing the earth-boring element 20 to apply such forces to the bottom or end of the borehole.

The hybrid bit 10 may be rotated while it defines the borehole or as it is introduced into an existing borehole. When the hybrid bit 10 encounters a material that the earth-boring element 20 cannot efficiently or effectively drill (e.g., an abrasive material, a material with a high compressive strength, etc.), such as chert, the percussion element 40 may enable the hybrid bit 10 to continue drilling into an earth formation without requiring removal of the drill string from the borehole.

In some embodiments, operation of the earth-boring element 20 and/or the percussion element 40 may be selectively controlled. Rotation of the earth-boring element 20 and WOB may be controlled in a manner known in the art. In embodiments where the percussion element 40 comprises a hydraulic percussion element, its operation may be controlled by controlling the hydraulic pressure generated by drilling fluid within the percussion element 40 and/or by controlling the force (e.g. WOB) applied to the bottom end 56 of the reciprocating member 50 of the percussion element 40 as the bottom end 56 contacts the bottom or end of the borehole.

As an example of selectively controlling operation of the earth-boring element 20 and/or the percussion element 40 of a hybrid bit 10, the hybrid bit 10 may be rotated to enable the earth-boring element 20 to drill into an earth formation. Rotation of the hybrid bit 10 to cause the earth-boring element 20 to drill into and remove material from an earth formation may occur with or without operation of the percussion element 40. When the hybrid bit 10 encounters a material that its earth-boring element 20 cannot efficiently or effectively drill, if the percussion element 40 was not previously operating, its operation may be initiated. If the percussion element 40 was operating prior to encountering the difficult-to-drill material, its operation may be continued. Rotation of the hybrid bit 10 may continue, or it may be discontinued as the hybrid bit 10 extends the borehole into the difficult-to-drill material. Once the hybrid bit 10 has extended the borehole through the difficult-to-drill material, operation of the percussion element 40 may, in some embodiments, be terminated. Alternatively, the percussion element 40 may continue to operate. If the hybrid bit 10 was not rotated while the hybrid bit 10 extended the borehole through the difficult-to-drill material, its rotation may be resumed once it again reaches material that it can effectively remove.

When use of the hybrid bit 10 is complete, it may be withdrawn from the borehole.

Although the foregoing description sets forth many specifics, these should not be construed as limiting the scope of any of the claims, but merely as providing illustrations of some embodiments and variations of elements or features of the disclosed subject matter. Other embodiments of the disclosed subject matter may be devised which do not depart from the spirit or scope of any of the claims. Features from different embodiments may be employed in combination. Accordingly, the scope of each claim is limited only by its plain language and the legal equivalents thereto.

What is claimed:

1. A hybrid bit for drilling a borehole into an earth formation, comprising:

a connector that can secure the hybrid bit to a bottom end of a bottom hole assembly on a drill string;

a fixed member extending along a length of the hybrid bit;

a percussion element including a reciprocating member that selectively oscillates over the fixed member and along a length of the hybrid bit with a bottom end that can interface with a bottom or end of the borehole during drilling;

an earth-boring element surrounding at least a portion of the reciprocating member of the percussion element, the bottom end of the reciprocating member extendable beyond a nose of the earth-boring element to enable the bottom end of the percussion element to constantly contact and vibrate against the bottom or end of the borehole while the percussion element oscillates.

2. The hybrid bit of claim 1, further comprising:

a plurality of button inserts carried by the bottom end of the reciprocating member of the percussion element and protruding beyond the nose of the earth-boring element.

3. The hybrid bit of claim 1, wherein the bottom end of the reciprocating member of the percussion element is retractable into the earth-boring element.

4. The hybrid bit of claim 1, wherein the earth-boring element is configured as a drag bit.

5. The hybrid bit of claim 1, wherein the percussion element comprises a hydraulic percussion element.

6. The hybrid bit of claim 5, including hydraulics that can split a flow of drilling fluid between the hydraulic percussion element and the earth-boring element.

7. The hybrid bit of claim 1, wherein the percussion element comprises a pneumatic percussion element.

8. The hybrid bit of claim 1, wherein the percussion element can oscillate without oscillating the earth-boring element.

9. A hybrid bit for drilling a borehole into an earth formation, comprising:

a connector that can secure the hybrid bit to a bottom end of a bottom hole assembly on a drill string;

a fixed member extending along a length of the hybrid bit;

a percussion element including a reciprocating member that can oscillate over the fixed member and along a length of the hybrid bit;

an earth-boring element including a nose around a bottom portion of the reciprocating member beyond the nose of the earth-boring element to facilitate constant contact of the bottom end of the percussion element with a bottom or end of the borehole and vibration of the bottom end of the percussion element against the bottom or end of the borehole during oscillation of the reciprocating member.

10. The hybrid bit of claim 9, wherein the earth-boring element is configured as a drag bit.

11. The hybrid bit of claim 9, wherein the percussion element comprises a hydraulic percussion element.

12. The hybrid bit of claim 11, including hydraulics that can split a flow of drilling fluid between the hydraulic percussion element and the earth-boring element.

13. The hybrid bit of claim 9, wherein the percussion element comprises a pneumatic percussion element.

14. The hybrid bit of claim 9, wherein the percussion element can induce oscillation of the reciprocating member without inducing oscillation in the earth-boring element.

15. A method for drilling a borehole in an earth formation, comprising:

drilling into the earth formation with a hybrid bit with a reciprocating member of a percussion element at least partially surrounded by an earth-boring element into the earth formation while an acceptable weight on bit enables the earth-boring element to operate at a desired rate of penetration; and without removing the hybrid bit from the earth formation, oscillating the reciprocating member of the percussion element over a fixed member extending along a length of the hybrid bit while the acceptable weight on bit holds at least a portion of a bottom surface of the reciprocating member against a bottom or end of the borehole to introduce vibrations into the bottom or end of the borehole.

16. The method of claim 15, further comprising:

retracting the reciprocating member of the percussion element.

17. The method of claim 15, wherein oscillating the reciprocating member of the percussion element includes oscillating the reciprocating member of the percussion element without causing the earth-boring element to drill further into the earth formation.

18. The method of claim 15, wherein oscillating the reciprocating member of the percussion element includes oscillating the reciprocating member of the percussion element while the earth-boring element continues to drill into the earth formation.

19. The method of claim 15, further comprising:

during and/or after oscillating the reciprocating member of the percussion element, drilling further into the earth formation with the earth-boring element.

20. The method of claim 15, further comprising:

rotating the reciprocating member of the percussion element.

* * * * *